United States Patent [19]

Luscomb

[11] 4,422,424

[45] Dec. 27, 1983

[54] ELECTRONICALLY CONTROLLED FUEL INJECTION PUMP

[75] Inventor: Douglas A. Luscomb, Mt. Upton, N.Y.

[73] Assignee: The Bendix Corporation, Southfield, Mich.

[21] Appl. No.: 276,608

[22] Filed: Jun. 23, 1981

[51] Int. Cl.[3] ..... F02M 51/00

[52] U.S. Cl. ..... 123/447; 123/458; 123/502

[58] Field of Search ..... 123/447, 446, 445, 458, 123/501, 502, 457

[56] References Cited

U.S. PATENT DOCUMENTS

| | | | |
|---|---|---|---|
| 2,922,581 | 1/1960 | Garday | 239/5 |
| 3,547,092 | 12/1970 | Knight | 123/447 |
| 3,587,547 | 6/1971 | Hussey et al. | 123/447 |
| 3,779,225 | 12/1973 | Watson et al. | 123/458 |
| 3,835,829 | 9/1974 | Links | 123/458 |
| 3,837,324 | 9/1974 | Links | 123/457 |
| 4,106,458 | 8/1978 | Kohler | 123/457 |
| 4,219,154 | 8/1980 | Luscomb | 123/457 |
| 4,249,497 | 2/1981 | Eheim et al. | 123/446 |
| 4,280,464 | 7/1981 | Kanai et al. | 123/447 |

*Primary Examiner*—Ira S. Lazarus
*Assistant Examiner*—Magdalen Moy
*Attorney, Agent, or Firm*—Charles D. Lacina

[57] ABSTRACT

A fuel injection pump (100) including a plunger (2) and a piston (1) movably disposed in a pumping chamber (17), means for initiating (3, 5) fuel injection and means for terminating (13, 30, 29) fuel injection, the plunger periodically pressurizing fuel in a pressure chamber (44) and the piston (1) spaced from the plunger and allowing a metering chamber (16) to fill with a metered quantity of fuel to be injected to an engine. The means for initiating injection comprise a pilot valve (5) having a solenoid to selectively operate between either of two states and a spool valve (3) movable between first and second positions in response to the state of pilot valve (5), the first position filling the metering chamber with the metered quantity of fuel. The pilot valve (5) determines the fuel quantity to be delivered to the engine relative to a signal from an electronic controller. An accumulator (4) is pressurized during each cycle of the plunger to provide pressurized fuel during a metering phase. A variable orifice (15) adjusts the rate of flow during the time fuel is being metered to metering chamber (16).

25 Claims, 11 Drawing Figures

FIG. 2
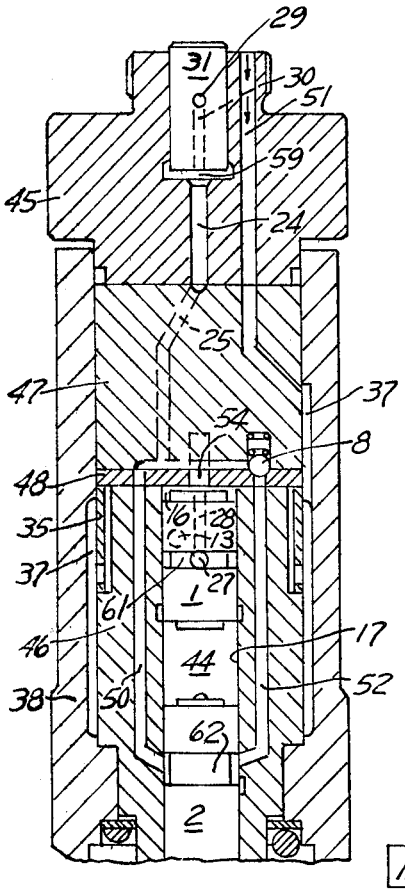
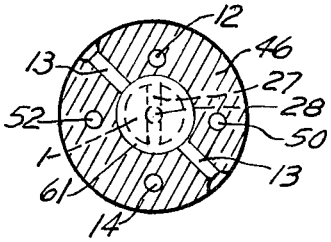
FIG. 4
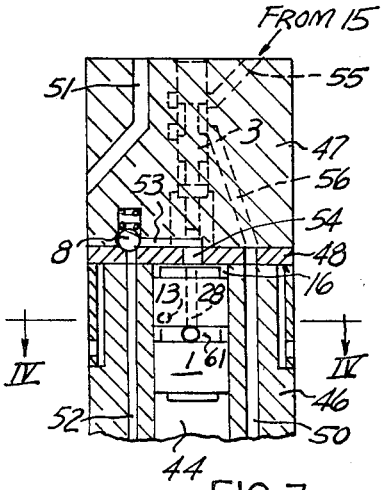
FIG. 3
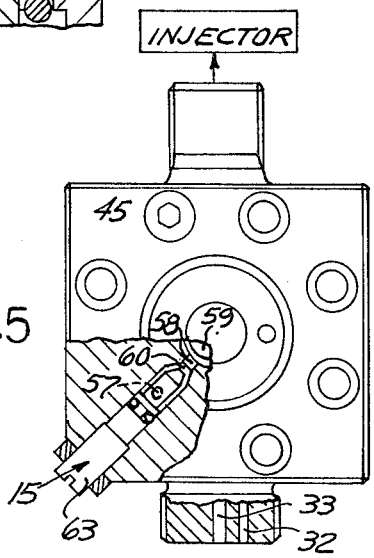
FIG. 5

DE-ENERGIZED

CONTROLLER/OPERATIONAL PHASES

ELECTRONICALLY CONTROLLED FUEL INJECTION PUMP

BACKGROUND OF THE INVENTION

This invention relates generally to fuel injection pumps, and more particularly to electronically controlled, solenoid operated fuel injection pumps of the so-called jerk pump type adapted for use with Diesel and internal combustion engines.

In applying an injection pump to an engine, the pump must fulfil requirements for capacity, injection duration, injection pressure, injection timing and in some cases control rack travel.

Jerk pumps commonly comprise a plunger disposed in an injection barrel which receives an amount of fuel to be pressurized. The plunger is mechanically driven by the engine as by a driving connection with an engine cam shaft so as to produce an injection of fuel at an appropriate point in the engine cycle by movement of the plunger in the barrel towards an injection chamber. The increased pressure in the injection chamber causes the opening of an injection delivery valve to thereby cause injection of the metered fuel charge into the associated engine cylinder.

In the jerk pump, both the quantity of fuel injected into the injection chamber for each injection cycle and also the timing of such fuel injection must be controlled. In the past it has been the practice to provide the plunger with a helical groove which cooperates with ports formed in the barrel to control the bypass of fuel from the injection chamber. In a traditional port-helix jerk pump, injection is terminated when the helix on the plunger covers a spill port in the barrel. When this occurs, depending upon the relative angular position of the helix to the spill port, the quantity of fuel to be delivered has been controlled. (See U.S. Pat. No. 2,922,581 issuing Jan. 26, 1960 to Garday for a Fuel Injection Apparatus). Means have also been provided for rotating the plunger to change the position of the helix within the barrel to produce a variation in bypass flow and hence in the quantity and timing of fuel injection for a giving injection cycle.

This arrangement is relatively simple, reliable and has found widespread application. However, the limits within which the quantity and timing parameters of fuel injection may be varied by such grooves and ports are such that it is difficult to achieve precise control over these parameters for maximum engine efficiency and/or emission control.

In an effort to provide improved control over these parameters, arrangements for providing electrical control over the injection consisting of valving means and associated intensifiers which are operated wholly by electronic fuel control systems have been suggested. U.S. Pat. No. 4,219,154 issuing Aug. 82, 1980 to Luscomb shows an electronically controlled fuel injection system which does not include an accumulator charged by a piston for supplying metered fuel.

In a jerk pump arrangement shown in U.S. Pat. No. 3,779,225 issuing Dec. 18, 1973 to Watson, et al, leakage may be present in the control valving which affects the preciseness and efficiency of the injection process.

Ine one application an electronically controlled valve was provided to provide both injection and metering functions. This pump arrangement required very fast turnaround times of the solenoid in the valve when dealing with small fuel quantities. Also this pump did not deliver a metered fuel charge. It would be desirable to provide an injection system that delivers a metered fuel charge and which has a separate accumulator that supplies pressure without resorting to a separate pump. A built-in accumulator could supply fuel at sufficient pressure to make a servo-valve and spool valve functional and also move a piston during metering.

SUMMARY OF THE INVENTION

The present invention overcomes the disadvantages stated with respect to the above referred to jerk pumps. A fuel injection pump comprises a floating piston 1 adapted to control termination of high pressure fuel injection and a spool valve 3 to control beginning of the injection. A multi-way pilot valve (servo-valve) 5 determines the timing of fuel delivery through the spool valve 3 based on events in the engine cycle. As such, the subject pump provides for a fast response to engine needs, gives complete control over fuel quantities and injection timing not possible with aforesaid limitations of the plunger-helix geometry. The floating piston 1 allows for metered fuel quantities. To do this, its motion must be independent of a plunger 2 as determined by the state of the pilot valve 5. For injecting the metered fuel, motion of piston 1 must be dependent upon plunger 2 but, again as determined by the state of the pilot valve 5. Pressurized fuel for the duel purpose of supplying metered fuel and servo-valve operation is generated within the pump by reciprocating plunger 2 and accumulator 4.

The jerk pump according to the subject invention utilizes spill ports to terminate injection. Electronically controlled valving is utilized to control timing of injection and to control the metering of a quantity of fuel for each injection.

A metering adjustment screw can adjust the metered fuel quantity delivered to the metering chamber during a metering time period.

ADVANTAGES OF THE PRESENT INVENTION

The present fuel injection pump can be electronically controlled with increased precision to overcome the shortcomings of the known fuel injection systems discussed above.

Another advantage of the present invention is the provision of means for calibrating the pump for use in supplying a predetermined quantity of fuel to a fuel injection system, the calibration being achieved by manually adjusting a variable orifice needle valve relative to a pump return flow passage.

Still another advantage of this invention is utilization of a pilot valve to determine fuel quantity to be delivered to an engine relative to a signal of fixed duration from an electronic controller.

Another advantage of the present invention is the provision of an electronically controlled solenoid operated fuel injection pump where the volume of fuel discharged to an engine during an injection phase is precisely and variably accumulated in a metering chamber during a preceding metering phase, the metered fuel subsequently being discharged by an injection piston.

Another advantage of the present invention is the provision of an electronically controlled means that is more responsive and sensitive to changes in engine requirements.

Yet another advantage is provision of a pump having the ability to vary beginning of injection of any fuel delivery quantity for a given time (i.e. advance or retard a quantity of fuel delivered) not capable by known port-helix type jerk pumps.

Other advantages attributable to the present fuel injection system will become apparent to the individual skilled in the art when the appended drawings are considered with the ensuing specification.

DESCRIPTION OF THE DRAWINGS

FIG. 2 is a partial section view taken along lines II—II of the pump of FIG. 1.

FIG. 3 is a partial section view taken along lines III—III of the pump of FIG. 1.

FIG. 4 is a transverse section view of a barrel in the pump taken along lines IV—IV of FIG. 3 showing spill ports.

FIG. 5 is a plan view, partially in section, of the pump of FIG. 1 showing a metering adjustment.

DESCRIPTION OF THE INVENTION

Figure 1:
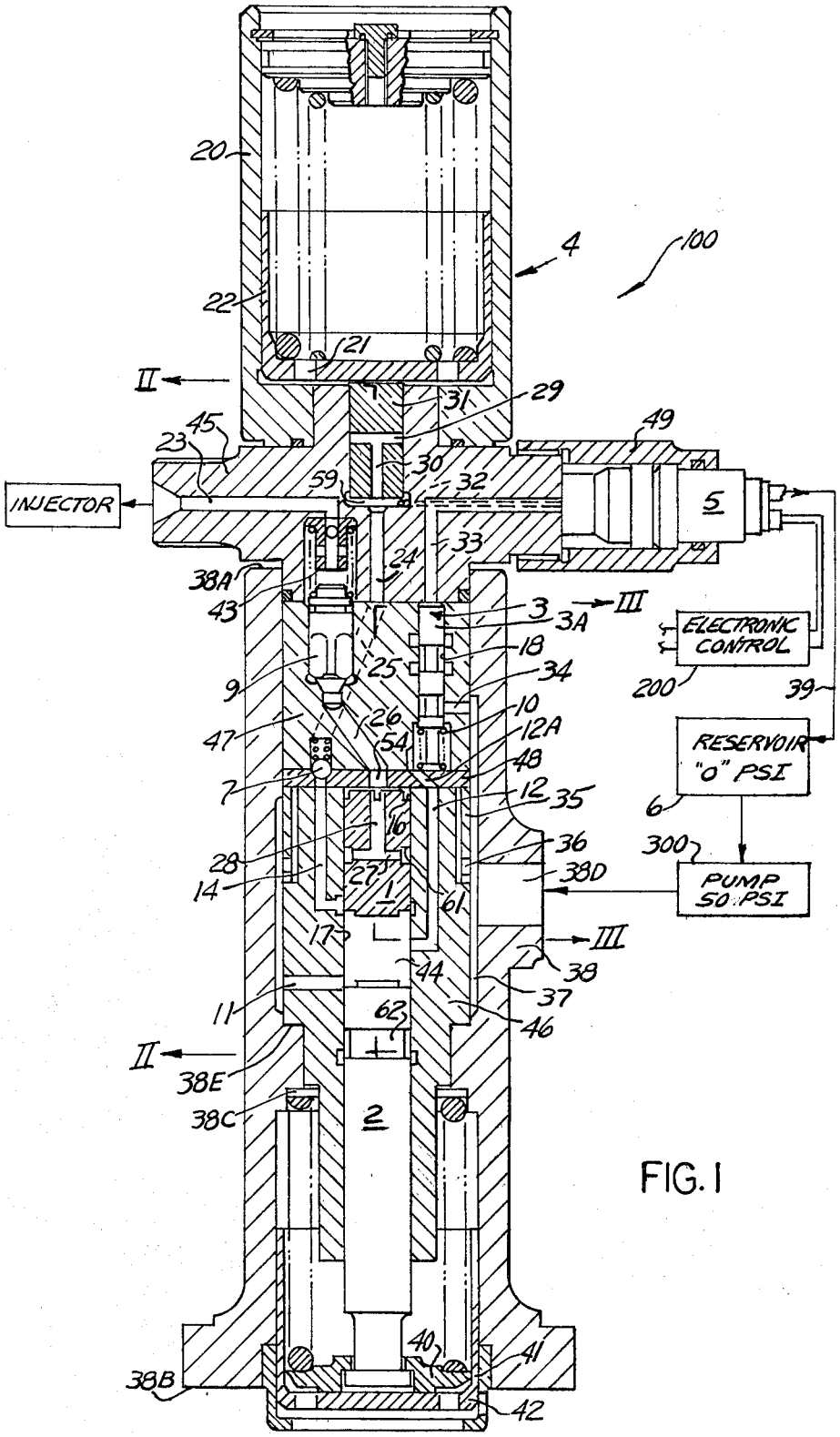
FIG. 1 is a view in section of a fuel injection pump according to the present invention.

Turning now to the drawings, FIG. 1 shows a fuel injection pump 100 to be mounted on an engine (not shown) and adapted to be driven by a cam of the engine to inject high pressure fuel to the engine. The pump 100 includes a spool valve 3 and a multi-way pilot valve 5 and utilizes a controller 200, the controller receiving electronic signals from events of the engine operation and transmitting electronic signals to energize or deenergize the pilot valve 5 to time the states of flow for communicating fuel. The valves cooperate to determine fuel quantity to be delivered to the engine and the timing of the delivery. For injection pump operation, an auxiliary pump 300 supplies low pressure fuel from a reservoir 6 (e.g. a fuel tank).

The fuel injection pump 100 is comprised of several elements which are interfitted to form a housing assembly, none of which being novel in and of themselves. The housing assembly includes a pump housing 38 having top and bottom ends 38A, 38B, a hollow interior 38C extending between the ends and an inlet 38D for supplying low pressure fuel to the interior 38C, the bottom end 38B being adapted to mount to the engine. The interior 38C of the pump housing includes an annular groove 37 and an internal shoulder 38E for positioning a barrel 46 therein relative to the inlet and groove. Positioned in the housing interior and above barrel 46 are, respectively, a stop plate 48, a valve housing body 47 and the bottom portion of a delivery valve holder 45. The delivery valve holder 45 receives an accumulator 4 and a support sleeve 49 for housing the multi-way pilot valve 5.

Barrel 46 includes an internal bore defining a pumping chamber 17, the pumping chamber including at a top portion thereof a metering chamber 16 and at a bottom portion thereof a pressure chamber 44. The barrel further includes an inlet 11 communicating the pumping chamber with the annular groove, a passage 12 communicating the pumping chamber with the spool valve 3 (i.e. a port receiving and discharging fuel), a spill port 13 (shown in FIGS. 2, 3 and 4) communicating metering chamber 16 with the low pressure fuel reservoir 6, a passage 14 communicating the pumping chamber with the accumulator 4 and a pair of passages 50, 52 for communicating metered fuel from the accumulator to a metering inlet passage 53 (shown best in FIG. 4), passage 50 communicating fuel through the spool valve and into the pumping chamber and passage 52 communicating fuel from the pumping chamber to the metering passage. The metering chamber 16 of the barrel is arranged to communicate a metered amount of fuel through an outlet 26 and into an injection passage 23 leading to the engine.

A floating piston 1 is movably mounted in the pumping chamber 17, the piston dividing the pumping chamber into the upper metering chamber 16 and the lower pressure chamber 44, movement of the piston periodically uncovering a port leading to passage 14 during an accumulator charging phase and spill ports 13 terminating an injection phase. The piston 1 includes an annular groove 61, a vertical center passage 28 and a cross-passage 27 opening into annular groove 61, center passage 28 communicating with metering chamber 16 and cross-passage 27 with annular groove 61, this groove and cross-passage 27 being brought into register with spill ports 13 upon upward movement of the piston.

A plunger 2 is connectibly mounted to a cam mechanism to be driven or reciprocated within the pumping chamber 17 of barrel 46 in spaced apart relation to the piston 1. An annular groove 62 is disposed about the circumference of the plunger. Initially, annular groove 62 is in register with the metering circuit passages 50, 52. Reciprocation of the plunger periodically moves groove 62 from register with passages 50, 52 to close the passages 50, 52 and seal the pumping chamber from fuel being communicated there across by passage 50 from the spool valve. Upward movement of plunger 2 forces the fuel upwardly and pressurizes the fuel in pressure chamber 44 to a predetermined pressure, the increase in fuel pressure in the pressure chamber to the predetermined pressure forcing the piston upward into the metering chamber 16 and causing the fuel therein also to be pressurized to the predetermined pressure.

Disposed at the bottom end of the barrel interior 38C is a spring cup 42 having a spring which biases against a spring plate 40 disposed about the plunger, the spring forcing the plunger 2 down as the cam lift diminises at the end of a cycle. The cam (not shown) is adapted to bias against the follower cup and drive the plunger upwardly.

Stop plate 48, positioned between barrel 46 and valve housing 47, defines a limit on upward travel for piston 1 and includes various apertures to direct flow therebetween and provides seats for first and second check valves 7, 8. An aperture 54 communicates fuel from the metering chamber to a high pressure passage disposed in the valve housing 47.

A delivery valve 9 is mounted in a cavity extending between the delivery valve holder 45 and the valve housing 47. The delivery valve 9 includes a delivery valve stop 43 and a spring normally biasing a valve body against a port communicating with injection passage 26 to define the closed position. The delivery valve opens only upon the attainment of a predetermined passage which is sufficient to overcome the spring bias and force the valve body upwardly into an unseated position relative to outlet 26 from metering chamber 16.

Delivery valve 9, when opened, communicates fuel from the metering chamber 16 via the passage 26, through passage 23 and into an injector (not shown) which feeds the high pressure fuel to the engine.

Accumulator 4 stores pressurized fuel at a first pressure and supplies pressurized fuel to pilot valve 5 to actuate spool valve 3 and supply the metering circuit with sufficient fuel for a metering phase of pump operation. The accumulator serves to provide fuel to the pump 100 at an elevated pressure to the valves 3, 5 at all times, including through a supply circuit 58, 60, 57 during the metering phase. The accumulator receives fuel during a charging phase via a passage 14. The accumulator includes an accumulator piston 31 movably disposed in a cavity formed in delivery valve holder 45, a housing 20 mounted to the delivery valve holder, a spring cup 22 disposed in the housing and adapted to resist upward movement of the accumulator piston, a plurality of springs mounted within the housing and the holder 45.

The accumulator piston 31 includes a T-passage comprised of a cross-passage 29 intersected by a vertical central passage 30. A recess (cavity) 59 is formed in the cavity below the accumulator piston 31. In an accumulator charging phase, the cavity (and accumulator) receives fuel under pressure from pressure chamber 44, the fuel being communicated thereto via passage 14, an aperture in plate 48 leading to the first check valve 7, a diagonal passage 25 passing through the valve housing 47 and a vertical passage 24 in the delivery valve holder 45. In the accumulator charging passage, pressurized fuel from pressure chamber 44 forces accumulator piston 31 upwardly to a predetermined point determined by cross-passage 29 to fill the accumulator housing. Accumulator filling ends when the cross passage 29 of the accumulator piston 31 is extended into the accumulator housing, the excess fuel from pressure chamber 44 being communicated to reservoir 6. Accumulator charging also accumulates a sufficient quantity of fuel in recess (cavity) 59 to be communicated to the metering chamber during the metering phase of the pump operation. During the metering phase, pilot valve 5 directs fuel through the spool valve, the pumping chamber and into the metering chamber 16.

The pilot valve supply line 32 extends from the recess (cavity) 59 to the pilot valve 5 to operate the spool valve 3. The accumulator periodically receives pressurized fuel from the pressure chamber 44 via the pressure port 14 and discharges pressurized fuel to the metering chamber via the metering passages 50, 52.

Electronic control means associated with the reciprocation of the plunger 2 controls timing of injection of the pressurized fuel, and includes actuation means for initiating fuel metering 3, 5 and means for terminating fuel injection 13, 27, 28.

The actuation means comprises pilot valve 5 communicating with inlet 32 for receiving high pressure fuel from the accumulator recess 59, an outlet (i.e. inlet/outlet drain) 33, a by-pass outlet 39 and an electromagnetically operated solenoid (400), the solenoid being selectively operable to provide a de-energized first state to communicate fluid between the inlet 32 and the outlet 33 during an accumulator pressurizing phase and a hold phase and an energized second state to communicate fluid between the outlet 33 and the by-pass 39 during the metering phase and the injection phases.

The actuation means further comprises spool valve 3 having a chamber 18, a spring 10 and a spool member 3A movable in the chamber 18 between first and second seated and unseated positions depending upon the state of the solenoid, the energized first state seating the spool member 3A and allowing accumulator fuel to communicate with the metering chamber and the de-energized second state allowing accumulator fuel to act against the spool member, thus unseating the spool member such that the fuel communicates from pressure chamber 44 with the supply 6 via a port 34.

Spool member 3A includes three spaced spool parts, the first spool part being acted upon by spring 10 to block full communication between the pressure chamber and the supply as well as to seat the spool member. The second and third spool parts act to selectively cover or uncover ports of the spool chamber, depending on the state of pilot valve 5. Spool chamber 18 includes inlet ports 33, 55 and 12A and outlet ports 56 and 34, passage 12A communicating with pressure chamber port 12 and passage 56 communicating with metering chamber inlet 53. When the pilot valve is in the energized first state, spring 10 biases the spool into the seated position and the spool part permits fuel to pass between ports 55 and 56 in the metering phase and low pressure fuel behind the spool to communicate via drain port 33 and passage 39 with the low pressure reservoir. When the pilot valve is in the de-energized second state, the spring 10 bias is not sufficient to resist high pressure fuel communicated to the spool from the accumulator via passages 32 and 33, thus the spool is unseated and fuel communication through passages 55, 56 cut off. However, passages 12, 12A are now able to communicate fuel between the pressure chamber 44 and the reservoir.

The controller 200 receives a signal from the engine, based on engine events, and sends a signal to pilot valve 5, depending on the state of plunger 2. Pilot valve 5 generally feeds/bleeds fuel or pressurizes an area/depressurizes an area depending upon its two states.

Means for terminating fuel injection comprises T-shaped passage of the piston 1 being brought into register, as a result of upward movement of the piston, with the relief port 13 in the barrel 46. As a result of metering chamber 16 receiving fuel under pressure from the accumulator cavity 59, the piston is initially displaced downwardly in pumping chamber 17. Then, as plunger 2 moves upwardly in the pumping chamber, first closing off metering passages 50, 52 and passage 11. The fuel in pressure chamber 44 is captured and pressurized whenever passage 12 is closed off from passage 34 by the spool valve (i.e. energizing pilot valve 5 to the first state). Further increase in pressure in the pressure chamber exceeds the pressure of the metered fuel in metering chamber 66, causing the piston to be forced upwardly, ultimately causing cross-passage 29 to register with spill ports 13. This registering allows pressurized fuel in metering chamber 16 to bleed therefrom, lowering the pressure in the metering chamber below the predetermined pressure whereby the delivery valve 9 closes the injection port and injection terminated.

FIG. 2 shows the pump 100 partially in section. A relief passage 51 extend through the delivery valve holder 45 and valve housing 47 to supply to the annular groove 37.

Also shown is the second check valve 8 which comprises a spring normally biasing a ball into an aperture of stop plate 48 to close off fuel communication through passage 52 leading to the metering passage 53, which in turn is supplied by metered fuel from passage 50 around plunger groove 62 through the chamber to passage 52 which overcomes the spring bias to supply the metered fuel through aperture 54 and to the metering chamber.

Floating piston 1 is shown with the annular groove 61 medial of its top and bottom faces and disposed about cross passage 27.

Fuel from passage 14 (for accumulator filling) is communicated through a passage 25 in valve housing 47, through a passage 24 in the delivery valve holder 45 and into the accumulator pressure cavity (recess) 59. The accumulator piston 31 shows (in phantom) vertical passage 30 and cross passage 29.

FIG. 3 shows a fragmentary section of valve housing 47, stop plate 48 and the barrel 46, valve housing 47 having the accumulator relief passage 51. Inlet metering line 55 is shown communicating fuel from metering adjustment 15 and spool valve 3 (shown in phantom). An outlet metering line 56 is shown communicating fuel from the spool valve to barrel passage 50.

FIG. 4 is a cross section of barrel 46 and clearly shows the piston 1 disposed in the pumping chamber, the barrel including transverse spill ports 13 to drain fuel from the annular groove 61 of the piston 1 as a result of the groove registering cross passage 27 therewith, metering circuit passages 50, 52, accumulator charging passage 14 and pressure chamber relief passage 12.

FIG. 5 shows a variable orifice 15 to adjust the rate at which the metered quantity of fuel is supplied from the accumulator 4 recess 59 to the metering chamber 16 during the time that a signal from controller 200 energizes pilot valve 5. The variable orifice 15 comprises a metering adjustment screw 63 mounted to the delivery valve holder 45, screw 63 having a forward tapered portion adapted to seat in a tapered recess of the holder. When not seated, a separation 60 occurs therebetween to allow fuel to communicate between metering line 57 (communicating with the inlet metering line 55 to spool valve 3) with a passage 58 leading to recess 59 in the accumulator. Rotation (opening of the screw 15) varies the quantity of pressurized fuel allowed to pass from the recess 59 to the pilot valve.

Figure 6:
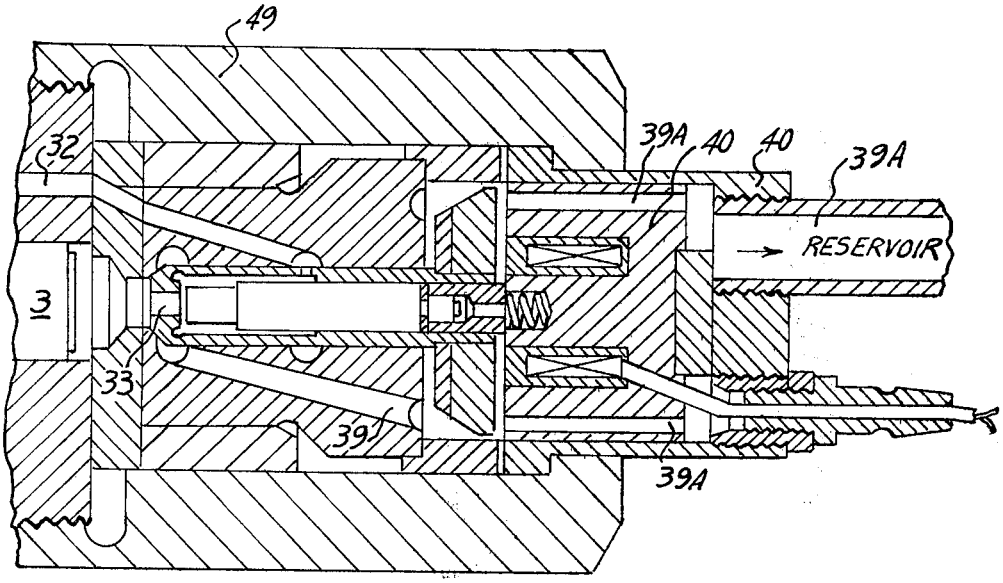
FIG. 6 is a section view of a pilot valve mounted to the pump of FIG. 1.

FIG. 6 shows a section view of the electromagnetic pilot valve 5. Although not novel in and of itself, the valve includes a solenoid 400 having a coil 401 which receives a signal from the controller 200 to activate a member to seat or unseat. A clear description is provided in the aforesaid U.S. Pat. No. 4,219,154. Spool member 3A is shown adjacent passage 33. Also shown are passages 32 and 39, passage 39 comprising passage portions 39A.

OPERATION

The operation of the fuel injection pump can be summarized with reference to the schematic FIGS. 7–11.

Figure 7:
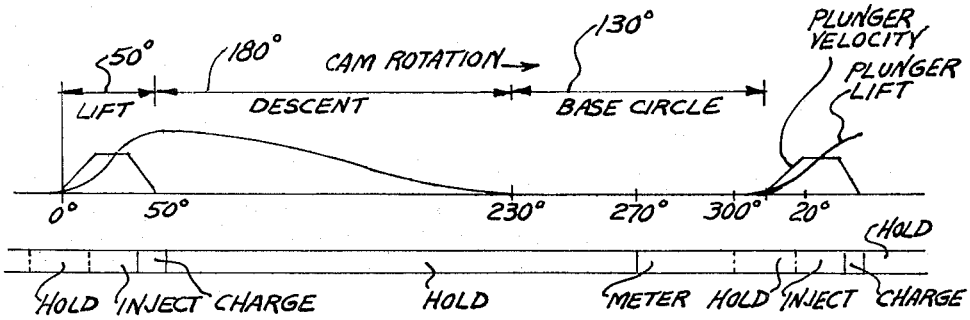
FIG. 7 is a schematic relating engine events, plunger movement and phases of the fuel injection.

FIG. 7 depicts rotation of the engine cam, lift of plunger (2) in the pumping chamber (17) and plunger velocity as a result of the cam rotation and the operational phases of the injection system. FIG. 7 assumes that the cam starts rotation at 0° with the plunger (2) being at its lowest point in the pumping chamber. Maximum plunger rise occurs at about 50° of cam rotation, the plunger returning to its lowest point at perhaps 230°. At a later time when the cam reaches 360° of rotation (i.e., returns to 0°), the plunger starts another rise (i.e., lift) and descent cycle.

Depending on the user's needs and/or application, the controller responds to messages from the engine to periodically energize the solenoid in pilot valve 5 to initiate metering and injection phases. At about 270°, the solenoid is energized and a metering phase begun. By varying the duration of this signal, the amount of fuel admitted to the metering chamber is varied, so that the quantity of fuel forced through the injector by the metering piston during the next injection phase is also varied. The time when each phase begins can also be varied. Perhaps at 300°, the solenoid is de-energized and a hold after metering phase initiated. Sometime after the cam reaches 360° (i.e., the cam returns to 0°) the cam starts the plunger rising, during which the solenoid is again energized (perhaps at 20°) and an injection phase initiated. As the plunger continues to rise, the solenoid is de-energized (perhaps at 40°) and piston 1 is driven upwardly to uncover the low pressure spill port 13 and the injection phase is terminated. Shortly before piston 1 reaches its maximum rise in its metering chamber, port 14 is uncovered to communicate fuel to the accumulator, after which period an accumulator charging period continues until the plunger reaches maximum upward lift in the pumping chamber (i.e., at 50°). The plunger then descends to its lowest point (i.e., at 230°) during which another hold period continues. The solenoid is again energized at 270° and the next metering phase begun.

Figure 8:
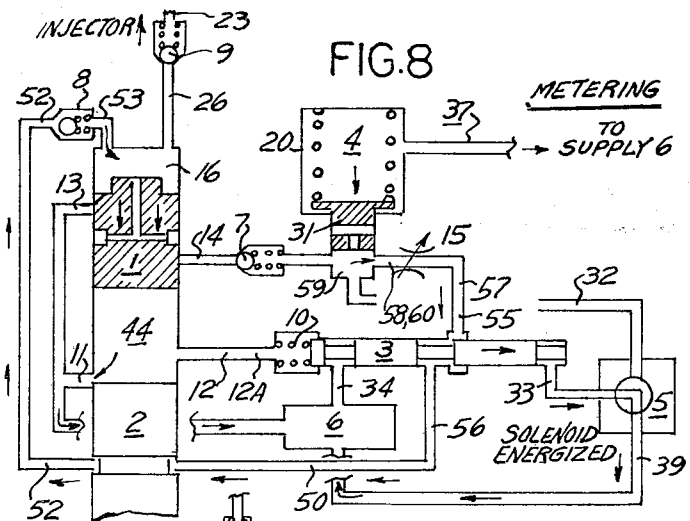

FIG. 8 reflects the metering phase. For the purpose of describing a complete cycle, assume that the cycle begins when plunger 2 has descended to the cam base circle position. Sometime after plunger 2 has descended to the cam base circle position, pilot valve (3-way servo-valve) 5 is energized by a signal from a controlled electrical power source, causing the solenoid to close the pilot valve supply line 32, which communicates high pressure fuel from the accumulator 4 to the spool valve chamber 18, and causing passage 33 to communicate with passage 39. As a result of the pilot valve 5 being energized, the spool (3A) of spool valve 3 is driven to the seated position since the (drain) supply line 33 is subject to fuel pressure of lesser amount than the pressure exerted by the spring 10. Fuel from behind the spool (3A) that is periodically under high pressure from the accumulator 4 when the servo-valve is in the de-energized state thereby bleeds back through passage 39 to supply 6 which is at substantially lower pressure.

Fuel under pressure from accumulator 4 flows through spool valve 3, from an outlet metering line 56 through a passage 50 and about an annular groove 62 formed around plunger 2, outwardly and through passage 52 leading therefrom to second check valve 8 and into a region above piston 1 forming a metering chamber 16, forcing the piston 1 to move downwardly in the pressure chamber 44. A fixed amount of fuel trapped in recess 59 of the accumulator substantially provides the only fuel available for flow to meter chamber 16 above piston 1.

The fuel below piston one in the pressure chamber 44, being at a lower pressure, flows out through inlet port 11 immediately above plunger 2 and back to supply 6.

Second check valve 8 is closed at the end of metering (i.e., when the flow ceases).

Figure 9:
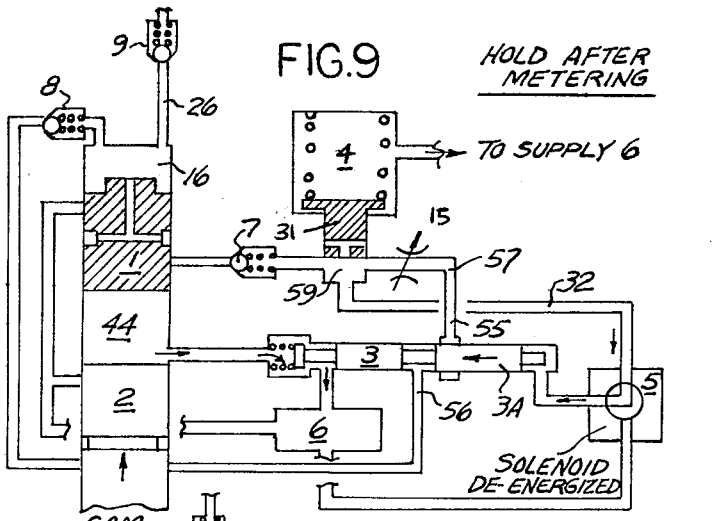
FIGS. 8–11 are circuit diagrams of the fuel injection pump, the circuit diagrams schematically representing respectively, metering, hold after metering, injection and accumulator charging modes.

As shown in FIG. 9, when the desired fuel quantity has been supplied to the metering chamber 16, based on a time flow, not dependent on the downward displacement of the floating piston 1, a signal is sent from the controller and pilot valve 5 is de-energized, whereby pressurized fuel from accumulator 4 is directed through supply lines 32 and 33 and back to the region in spool valve chamber 18 behind the spool valve 3, thereby overcoming the force of spring 10 and moving spool valve 3 into position where inlet metering line 55 is blocked from outlet metering line 56 thus ending further flow into metering chamber 16. Due to engine operation events, movement of the engine cam drives plunger 2 upwardly into the pressure 44, blocking off metering passages 50, 52 and inlet port 11.

Further flow of metering fuel to metering chamber 16 above floating piston 1 is blocked and fuel bleeding from the pressure chamber 44 through the inlet line to supply 6 is stopped, metering of fuel ends and a hold after metering period commences. The hold after metering period is between the end of metering and beginning of injection when the metered charge is held inactive, and includes towards its end the initial rising of plunger 2 by the cam.

A metering adjustment member 15 includes a variable orifice 60 which compensates for tolerance variations between pumps so that each pump can meter the same quantity of fuel for the same time period that the pilot valve 5 is energized.

In the hold after metering mode, pilot valve 5 remains de-energized while the plunger 2 runs out on the cam base circle and begins to lift upwardly in the interior bore 17 of barrel 46. Metered fuel in metering chamber 16 is at a higher pressure than fuel captured in pressure chamber 44. Low pressure fuel in the chamber 44, displaced upwardly during the plunger's initial lift (since inlet port 11 has been blocked) is forced through passage 12 and spool valve 3 and returns to supply 6.

Figure 10:
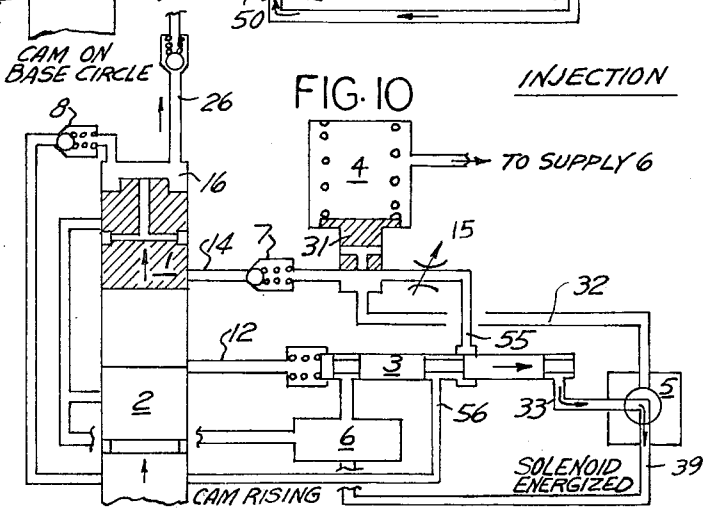

FIG. 10 is the injection phase. At the desired moment in the engine events, just after plunger 2 passes passage 11 but before it reaches passage 12, pilot valve 5 is energized and high pressure fuel from accumulator 4 is cutoff to line 33, simultaneously opening passage 33 to passage 39 and communicating fuel to the supply, thus lowering pressure acting on spool valve 3 so that spring 10 biases the spool into the seated position (as it was in the beginning of metering). Plunger 2, which covered ports 50, 52 and inlet port 11, now pressurizes fuel trapped above it in chamber 44 and forces floating piston 1 with its metered charge of fuel above it in metering chamber 16 to rise as well and be pressurized. When the plunger rises beyond the point at which the most retarded injection is required, passage 12 is closed off.

Delivery valve 9 to the injector is normally biased into a closed position. When the metered volume of fuel under pressure above floating piston 1 in the metering chamber 16 rises to a sufficiently higher pressure, the spring and any residual line pressure above delivery valve 9 is overcome to open the valve whereby the metered charge of fuel flows via passage 23 to the injector. Injection continues until the annular groove 61 around floating piston 1 uncovers a spill port 13, registering piston passages 27 and 28 therewith, whereby the high pressure of fuel above floating piston 1 can pass through passage 28, cross-passage 27 and spill into supply 6 via spill port 13, thereby dropping the pressure rapidly in line 26 serving the injector, such that the bias spring in delivery 9 reseats, thus ending injection. Simultaneously or slightly later, the bottom of piston 1 uncovers accumulator fuel passage 14 and shortly thereafter, floating piston 1 abuts the top of internal bore 17 and can lift no further.

Figure 11:
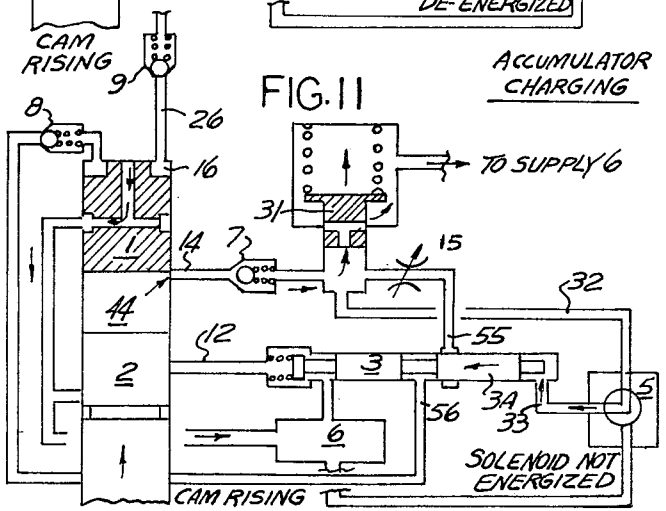

FIG. 11 represents this later condition and is an accumulator charging mode. Although floating piston 1 has stopped moving upwardly after injection, plunger 2 continues upward, displacing fuel above it though accumulator fuel passage 14 and first check valve 7. At some time prior to the end of injection, but after passage 12 is covered by the rising plunger 2, pilot valve 5 is de-energized, which unseats spool valve 3 so as to block flow across it to outlet metering line 56 but allow flow through passage 34 to supply 6. Plunger 2 covers passage 12 as soon as possible after the passage is no longer needed to intiate injection (timing). This relieves the spool of its task of sealing off chamber 44 so that the solenoid can be de-energized, thereby saving power and reducing heat build up in its coil.

Fuel displaced through accumulator flow passage 14 and first check valve 7 is therefor forced into accumulator 4. When plunger 2 reaches the end of its stroke and displacement ceases, pressure equalizes in the check valve and the spring in first check valve 7 closes the valve, thereby trapping fuel sufficient for the next cycle.

Accumulator 4 by passes excess fuel from the pressure chamber back to supply 6 via passage 51 after the accumulator piston reaches a certain height in the accumulator bore. This protects the accumulator from overstroking and ensures a uniform pressure and charge cycle to cycle.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

I claim:

1. A fuel injection pump (100) for supplying pressurized fuel to an engine, characterized by:

a housing assembly (38, 45, 46, 47, 48, 49) provided with an internal bore (17) defining a pressure chamber (44) having an inlet/outlet port (12) for receiving and discharging fuel and a metering chamber (16) having an inlet (53) for receiving a metered quantity of fuel and an outlet (26) for discharging pressurized fuel;

a plunger (2) connectibly driven by the engine for reciprocation in the pressure chamber;

a floating piston (1) movably disposed within said bore in spaced relation to the plunger;

a spool valve chamber (18) located within said housing assembly and having a first port (12A) communicating with the pressure chamber port (12), a second port (56) communicating with the metering chamber inlet (53) and a drain outlet;

a spool member (3A) movable within the spool valve chamber (18) between seated and unseated positions;

an accumulator (4) pressurized by reciprocation of the plunger (2) to provide high pressure fuel to the pump, the accumulator providing fuel to the spool valve chamber and to the metering chamber and having a recess (59) for receiving a sufficient amount of pressurized fuel;

a pilot valve (5) adapted to be energized and de-energized to selectively establish first and second states of flow for communicating fuel between the accumulator (4) and the spool valve chamber (18), the energized state causing the spool member to be seated and the de-energized state causing the spool member to be unseated;

a normally closed delivery valve (9) operable by a predetermined pressure to open and communicate the metered quantity of fuel in the metering chamber (16) through outlet (26) to the engine, this communication of the metered quantity of fuel representing an injection phase of the pump operation;

means for terminating (13, 27, 28) the injection phase as a result of piston (1) being displaced upwardly in the bore (17);

such that when the pilot valve (5) is energized, the spool member (3A) is seated and fuel communicates through the spool chamber into the metering chamber to displace piston (1) downwardly, during which time metering chamber (16) is filled with the metered quantity of fuel, whereupon the pilot valve is de-energized and the spool member is unseated, the plunger rises and pressurizes fuel in the pressure chamber (44) to the predetermined pressure, whereby the piston is displaced upwardly and the metered quantity of fuel is pressurized to the predetermined pressure to open the delivery valve and is discharged through the delivery valve to the engine.

2. A fuel injection pump as required in claim 1 further comprising:

an electronic controller (200) adapted to respond to events in the engine cycle and to periodically supply a signal to activate the pilot valve, thereby timing the states of flow for communicating fuel; and variable orifice means associated with the accumulator for adjusting (15: 58, 60, 57) the metered quantity of fuel communicated to the metering chamber during the time that a signal from the controller energizes the pilot valve (5).

3. A fuel injection pump as required in claim 1 wherein said bore (17) includes a port (14) communicating with the accumulator and periodically uncovered by piston (1) and wherein said pilot valve (5) is normally in the de-energized state and is only energized intermittently to communicate the metered quantity of fuel to metering chamber (16) during a metering phase of the pump operation and to inject the metered quantity of fuel to the engine during the injection phase, said injection phase causing piston (1) to uncover port (14) to deliver pressurized fuel to the accumulator, thereby pressurizing the accumulator for the next metering phase of the pump operation.

4. A fuel injection pump as required in claim 1 wherein said termination means includes said housing assembly having a spill port (13) communicating with a low pressure and said piston (1) includes passages (27, 28) in communication with metering chamber (16), such that when piston (1) is driven upwardly, the passages communicate with spill port (13) and communicate fuel from metering chamber (16) to the spill port (13), whereupon the predetermined pressure in metering chamber (16) falls and delivery valve (9) closes, thereby terminating injection of fuel to the engine.

5. A fuel injection pump as required in claim 4 wherein said housing assembly includes a pair of spill ports (13) communicating with low pressure and wherein passages (27, 28) form a T-shape, wherein passage (27) being adapted to be brought into register with the pair of spill ports and passage (28) communicating with high pressure fuel in metering chamber (16).

6. A fuel injection pump as required in claim 1 further including a reservoir (6) storing a supply of low pressure fuel, said reservoir communicating its fuel to the pressure chamber and receiving fuel from the spool chamber and the pressure chamber.

7. A fuel injection pump as defined in claim 1 wherein said accumulator (4) includes an accumulator piston (31) having a pair of passages (29, 30) formed into a T-shape passage, one passage (30) communicating with the recess (59) storing the fuel for metering and the other passage (29) communicating with a low pressure reservoir (6), such that after piston (1) uncovers port (14), high pressure fuel is communicated from pressure chamber (44) to recess (59), whereupon accumulator piston (31) rises to a predetermined point determined by cross-passage (29), thereby communicating excess high pressure fuel from the pressure chamber (44) to the reservoir (6).

8. A fuel injection pump (100) for use with an engine, the pump being of the type including a housing provided with an internal bore (17), means communicating with the bore for receiving low pressure fuel, a plunger (2) connectibly mounted to the engine for reciprocation in the bore to pressurize fuel received therein and means for discharging pressurized fuel to the engine, the pump further characterized by:

a pilot valve (5) located within the housing and selectively operable between an energized first state and a de-energized second state;

an accumulator (4) for storing pressurized fuel, said accumulator communicating with internal bore (17) for receiving pressurized fuel therefrom by reciprocation of the plunger (2);

means for terminating (13, 1:27, 28) fuel injection to the engine, said terminating means comprising a spill port (13) communicating with a low pressure reservoir and a floating piston (1) movably disposed in the bore above and in spaced apart relation to the plunger and having a cross-passage (27) communicating with a vertical passage (28), that portion of the bore disposed above piston (1) defining a metering chamber (16) communicating with passage 28 and that portion of the bore disposed between the piston (1) and the plunger (2) defining a pressure chamber (44), such that upon displacement of piston (1) in a first direction, metering chamber (16) receives a metered charge of fuel and such that displacement of piston (1) in a second direction, piston (1) discharges the fuel from the metering chamber to the engine and causes cross-passage (27) to register with spill port (13), thereby communicating high pressure fuel from the metering chamber to the low pressure reservoir; and means for intiating (3, 3A) fuel injection to the engine, said initiating means including a spool valve (3) having a spool member (3A) movably mounted within a spool chamber (18), the spool member being mounted for reciprocation between a spool member seated position when pilot valve (5) is energized and a spool member unseated position when pilot valve (5) is de-energized, the spool member seated position communicating fuel to be metered from the accumulator to the metering chamber and controlling the start of injection of fuel, said accumulator supplying pressurized fuel to metering chamber (16) through spool valve (3) when the pilot valve (5) is energized.

9. A fuel injection pump as required in claim 8 further comprising:

a controller (200) associated with engine events and with the plunger (2) reciprocation determining the frequency and duration that pilot valve (5) is energized and de-energized.

10. A fuel injection pump (100) for supplying pressurized fuel, characterized by:

a barrel (46) having a pumping chamber (17), said pumping chamber communicating with a first outlet (26), a metering inlet (53), conduit means (50, 52) passing metered fuel to the metering inlet, a second inlet (11) and a second outlet (14);

a piston (1) movably mounted in said pumping chamber (17), said piston dividing the pumping chamber into a metering chamber (16) adjacent said metering inlet (53) and said first outlet (26) and a pressure chamber (44) adjacent said second inlet (11), movement of said piston periodically uncovering the second outlet (14);

a plunger (2) mounted for reciprocation in said pressure chamber (44) in spaced apart relation to the piston, said reciprocation periodically closing said conduit means (50, 52) and pressurizing fuel in said pressure chamber (44) to a predetermined pressure, the predetermined pressure displacing piston (1) upwardly and into metering chamber (16) and pressurizing fuel therein to the predetermined pressure;

delivery valve means for closing (9) said first outlet (26) until the predetermined pressure is attained in metering chamber (16);

an accumulator (4) for storing fuel at a first pressure less than said predetermined pressure, said accumulator periodically receiving pressurized fuel from pressure chamber (44) via second outlet (14) and discharging pressurized fuel to metering chamber (16) via conduit means (50, 52);

initation means for initiating (3, 5) fuel metering and fuel injection; and means for terminating (13, 27, 28) fuel injection;

said pump being such that when plunger (2) is in a first position, the conduit means (50, 52) is open and the metered fuel flows through metering inlet (53) and into metering chamber (16), driving piston (1) downwardly in pumping chamber (17) until a later time when the flow of fuel to metering chamber is terminated, rise of the plunger (2) from the first position increasing the pressure in the pressure chamber (44) and forcing piston (1) upwardly into metering chamber (16) until the fuel therein reaches the predetermined pressure, thereby causing delivery valve (9) to open and to pass fuel through outlet (26) for injecting to the engine, further rise of plunger (2) forcing piston (1) upwardly to uncover second outlet (14) whereupon the accumulator is pressurized.

11. A fuel injection pump as required in claim 10 wherein said initiation means comprises:

a pilot valve (5) having an inlet (32) for receiving fuel from accumulator (4), an outlet (33), a by-pass (39) and including an electromagnetically operated solenoid (400) selectively operable between an energized state to communicate fuel between said outlet (33) and said by-pass (39) during the metering phase and the injection phases and a de-energized state to communicate fuel between said inlet (32) and said outlet (33) during an accumulator pressurizing phase and during a hold phase; and a spool valve member (3) having a chamber (18) with several inlets (12, 33, 55) and several outlets (34, 56) and including a spool member (3A) movable in the chamber (18) between first and second positions depending upon the energization state of the solenoid, the energized state allowing fuel to communicate between inlet (55) and outlet (56) and representing the first position and the de-energized state allowing fuel to pass through the inlet (32) to the outlet (33) to force the spool member (3A) into the second position, whereby inlet (12) communicates pressure chamber (44) with a low pressure reservoir.

12. A fuel injection pump as required in claim 10 wherein:

said means for terminating fuel injection includes said pumping chamber (17) including a spill port (13) and piston (1) being provided with a passage means (27, 28) for spilling high pressure fuel from the metering chamber (16), said passage means (27, 28) being brought into register with spill port (13) as a result of said piston moving upwardly in metering chamber (16), pressure relief of pressure in metering chamber (16) lowering fuel pressure therein below said predetermined pressure whereby delivery valve means (9) closes outlet (26) and injection is terminated.

13. A fuel injection pump as required in claim 11 including a variable orifice (15: 57, 58, 60) for adjusting the rate of fuel flow during the time fuel is being metered to the metering chamber (16).

14. A fuel injection pump (100) for supplying pressurized fuel to an engine, characterized by:

a housing assembly (38, 45, 46, 47, 48, 49) having an internal bore (17) defining a pressure chamber (44) having an inlet (11) for receiving fuel at a first pressure and a metering chamber (16) having an outlet (26) for communicating fuel to the engine;

plunger means (2) for periodically pressurizing the fuel in the pressure chamber to a higher second pressure;

piston means (1) movably disposed in the bore in spaced-apart working relation with the plunger means for allowing the metering chamber to fill with a metered quantity of fuel at a third pressure and for expelling the metered quantity of fuel therefrom at the second pressure;

delivery valve means (9) for closing said outlet until said second pressure is attained in the metering chamber, attainment of the second pressure communicating the metered fuel to the engine;

electromagnetic means (3, 5) for initiating fuel injection, said electromagnetic means comprising:

a multi-way pilot valve (5) of the type having an inlet (32), a by-pass outlet (39), an inlet/outlet (33) and a solenoid (400) selectively operable between an energized first state whereby inlet/outlet (33) communicates with outlet (39) and a de-energized second state whereby inlet/outlet (33) communicates with inlet (32); and a spool valve (3) adapted to move between first and second positions, respectively, in response to said first and second energized states, said first position describing a metering phase wherein the metered quantity of fuel communicates to the metering chamber and also an injection phase wherein fuel communicates to the engine, said second position describing a hold after metering phase wherein the spool valve vents fuel from the pressure chamber in a high pressure relief phase; and means (13, 30, 29) for terminating fuel injection.

15. A fuel injection pump as required in claim 13 wherein said electromagnetic means comprises:

a multi-way pilot valve (5) of the type having an inlet (32), a by-pass outlet (39), an inlet/outlet (33) and a solenoid (400) selectively operable between an energized first state whereby inlet/outlet (33) communicates with outlet (39) and a de-energized second state whereby inlet/outlet (33) communicates with inlet (32); and a spool valve (3) adapted to move between first and second positions, respectively, in response to said first and second energized states;

said first position describing a metering phase wherein the metered quantity of fuel communicates to the metering chamber and also an injection phase wherein fuel communicates to the engine, said second position describing a hold after metering phase wherein the spool valve vents fuel from the pressure chamber and a high pressure relief phase.

16. A fuel injection pump as required in claim 15 wherein said electromagnetic means further comprises an electronic controller (200) responsive to the plunger means (2) for energizing the multi-way pilot valve (5) to regulate operation of the spool valve (3).

17. A fuel injection pump as required in claim 15 wherein:

said means for terminating fuel injection comprises a spill port (13) located in said housing assembly, said spill port communicating with a low pressure source; and said piston means (1) comprises an upwardly displaceable piston (1) having a cross-passage (27) communicating with a vertical passage (28), such that as said plunger means causes said pressure chamber pressure to increase to the second pressure, the piston (1) rises and increases the pressure in metering chamber (16) to the second pressure, whereupon delivery valve (9) opens outlet (26) to start the injection to the engine, further rise of the piston bringing cross-passage (27) into register with spill port (13), causing high pressure fuel in metering chamber (16) to be vented therefrom and delivery valve (9) to close, thereby terminating injection.

18. A fuel injection pump as required in claim 17, further comprising:

an accumulator (4) for storing fuel communicated from the pressure chamber, the accumulator periodically receiving pressurized fuel from the pressure chamber (44) via a pressure port (14) uncovered by the piston (1) upward movement and periodically discharging pressurized fuel to metering chamber (16) via spool valve (3).

19. A fuel injection pump as required in claim 17 further comprising a variable orifice (15: 57, 58, 60) for adjusting the rate at which fuel flows to the metering chamber (16) during the metering phase.

20. A fuel injection pump as required in claim 16 wherein accumulator (4) includes a recess (59) for accumulating a quantity of fuel, an accumulator piston (31) having a vertical passage (30) communicating with recess (59) and a cross-passage (29) and movably disposed in the recess for establishing uniform accumulator charge and an accumulator housing (20), communication of high pressure fuel from pressure chamber (44) filling recess (59) with a quantity of fuel necessary for the next injection cycle and displacing accumulator piston (31) upwardly into the housing (20) until such time as cross passage (29) reaches a predetermined level in the housing and communicates fuel via passage (30) from the recess into housing (20), thus by-passing further fuel flowing from pressure chamber (44) and establishing a maximum accumulator piston position which results in uniform accumulator charge, a uniform pressure being available each cycle, the charging phase terminating when plunger (2) reaches maximum cam lift.

21. A fuel injection pump as required in claim 14 wherein said electromagnetic means further comprises an electronic controller (200) responsive to the plunger means (2) for energizing the multi-way pilot valve (5) to regulate operation of the spool valve (3).

22. A fuel injection pump as required in claim 14 wherein:

said means for terminating fuel injection comprises a spill port (13) located in said housing assembly, said spill port communicating with a low pressure source; and said piston means (1) comprises an upwardly displaceable piston (1) having a cross-passage (27) communicating with a vertical passage (28), such that as said plunger means causes said pressure chamber pressure to increase to the second pressure, the piston (1) rises and increases the pressure in metering chamber (16) to the second pressure, whereupon said delivery valve means (9) opens outlet (26) to start the injection to the engine, further rise of the piston bringing cross-passage (27) into register with spill port (13), causing a high pressure in fuel in metering chamber (16) to be vented therefrom and said delivery valve means (9) to close, thereby terminating injection.

23. A fuel injection pump as required in claim 22, further comprising:

an accumulator (4) for storing fuel communicated from the pressure chamber, the accumulator periodically receiving pressurized fuel from the pressure chamber (44) via a pressure port (14) uncovered by the piston (1) upward movement and periodically discharging pressurized fuel to metering chamber (16) via spool valve (3).

24. A fuel injection pump as required in claim 22, further comprising a variable orifice (15: 57, 58, 60) for adjusting the rate at which fuel flows to the metering chamber (16) during the metering phase.

25. A fuel injection pump as required in claim 21 wherein accumulator (4) includes a recess (59) for accumulating a quantity of fuel, an accumulator piston (31) having a vertical passage (30) communicating with recess (59) and a cross-passage (29) and movably disposed in the recess for establishing uniform accumulator charge and an accumulator housing (20), communication of high pressure fuel from pressure chamber (44) filling recess (59) with a quantity of fuel necessary for the next injection cycle and displacing accumulator piston (31) upwardly into the housing (20) until such time as cross passage (29) reaches a predetermined level in the housing and communicates fuel via passage (30) from the recess into housing (20), thus by-passing further fuel flowing from pressure chamber (44) and establishing a maximum accumulator piston position which results in uniform accumulator charge, a uniform pressure being available each cycle, the charging phase terminating when plunger (2) reaches maximum cam lift.

* * * * *